US005615803A

United States Patent [19]

Hatakeyama et al.

[11] Patent Number: 5,615,803

[45] Date of Patent: Apr. 1, 1997

[54] TUBE CONTAINER

[75] Inventors: Yoshiharu Hatakeyama; Kenzo Teshima; Tatsuo Ishikawa, all of Tokyo, Japan

[73] Assignee: Yoshida Kogyo Co., Ltd., Tokyo, Japan

[21] Appl. No.: 426,845

[22] Filed: Apr. 24, 1995

[30] Foreign Application Priority Data

Dec. 15, 1994 [JP] Japan ..... 6-311556

[51] Int. Cl.[6] ..... B65D 35/22

[52] U.S. Cl. ..... 222/94; 222/105; 222/145.3; 222/212; 222/481.5

[58] Field of Search ..... 222/94, 105, 145.3, 222/212, 481.5, 491

[56] References Cited

U.S. PATENT DOCUMENTS

| | | | |
|---|---|---|---|
| 3,788,520 | 1/1974 | Dukess | 222/94 |
| 3,936,334 | 2/1976 | Kushida et al. | 222/94 X |
| 5,137,178 | 8/1992 | Stokes et al. | 222/94 |
| 5,332,121 | 7/1994 | Schmidt et al. | 222/105 X |
| 5,366,115 | 11/1994 | Kersten et al. | 222/481.5 X |

FOREIGN PATENT DOCUMENTS

| | | | |
|---|---|---|---|
| 1091936 | 10/1960 | Austria | 222/94 |
| 2220408 | 1/1990 | United Kingdom | 222/481.5 |

*Primary Examiner*—Joseph Kaufman

[57] ABSTRACT

A tube container has an outer tube formed with an extruding mouth at one end and two inner tubes each formed with an extruding mouth at one end. The inner tubes are inserted into the outer tube, and the extruding mouths of the two inner tubes are secured to the extruding mouth of the outer tube, respectively, while the other ends of the two inner tubes and the other end of the outer tube are pressed and welded together to form a hermetically sealed portion. The outer tube has a transverse cross section taking the form of an ellipse or a closed running track shape, namely a shape combining two semicircles with two straight lines. The inner tubes are arranged in the outer tube in the direction of major axis of the transverse cross section of the outer tube. The other ends of the two inner tubes and the other end of the outer tube are pressed in the minor axis of the transverse cross section and welded together, wherein the respective hermetically sealed portions of the two inner tubes have a length more than half of the hermetically sealed portion of the outer tube, and a part of one inner tube and a part of the other inner tube lie one upon the other.

6 Claims, 9 Drawing Sheets

TUBE CONTAINER

BACKGROUND OF THE INVENTION

1. Field of the Invention

The present invention relates to a tube container in which two kinds of contents such as drugs, medicine, and cosmetics can be preserved without coming into contact with each other, and of which two kinds of contents can be squeezed out at the same time for use.

2. Description of the Prior Art

A tube container for packing two kinds of contents is well-known which is comprised of an outer tube and two inner tubes inserted into the outer tube. Two kinds of contents are charged into each inner tube. The tube container is used as a container for containing drugs, medicine, and cosmetics, for example, which should be preserved without coming into contact with each other until just before the contents are used. A tube container is disclosed in a laid open utility model application, No. 56649/1992 (Heisei 4), in which an extruding mouth formed at one end of each of the two inner tubes and an extruding mouth of an outer tube are held together as a unit, while the other ends of each of the inner tubes and the outer tube are collapsed and welded together to form a bottom seal.

In this tube container, the outer tube is made of transparent or semitransparent materials, the two inner tubes are arranged in the lateral direction of the tube container in such a manner that a part of one inner tube and a part of another inner tube do not overlap. In this tube container, all the hermetically sealed portions are formed of welded four layered materials as compared with a conventional tube container in which two inner tubes are inserted into an outer tube, and the bottom ends of the inner tubes and the outer tube are welded together to form a six-layered sealed portion.

However, since any parts of the inner tubes are not superimposed, a lateral length of the collapsed bottom end of the inner tube is limited to a length less than one half of a lateral length of the collapsed bottom end of the outer tube. Accordingly, a volume of the inner tube is defined by the size of the outer tube. Further, in order to increase the volume of an inner tube, an outer tube has to be made larger so that the size of the tube container is increased.

Further, in a conventional tube container, after contents have been squeezed out from the inner tubes, a flexible outer tube is restored to the original shape. At this time, air flows into the inner tubes. Therefore, when subsequently using the contents in the tube container, unless air in the inner tubes is pushed out from the inside of the inner tubes by excessively pushing the outer tube, the contents in the tube container cannot be squeezed out from the tube container. Further, when the inner tubes are restored, there is a fear that one content in one of the inner tubes is drawn into the other inner tube together with air.

SUMMARY OF THE INVENTION

Accordingly, it is an object of the present invention to provide a compact tube container in which a needed volume of an inner tube can be secured, without increasing the size of an outer tube.

It is another object of the present invention to provide a tube container in which an inner tube is prevented from restoring to the original shape, and after contents have been squeezed out from the tube container, one content in one inner tube is prevented from being drawn into another inner tube together with air.

The first object of the present invention is achieved by providing a tube container comprised of an outer tube formed with an extruding mouth at one end and two inner tubes formed with an extruding mouth at one end thereof, the inner tubes being inserted into the outer tube, the extruding mouths of the two inner tubes being secured to the extruding mouth of the outer tube, and the other end of each of the two inner tubes and the other end of the outer tube being pressed and welded together to form a hermetically sealed portion, wherein the outer tube has a transverse cross section taking the form of an ellipse or a track, the two inner tubes are arranged in the outer tube in the direction of a major axis of the transverse cross section of the outer tube, and the other end of each of the two inner tubes and the other end of the outer tube are pressed on a minor axis of the transverse cross section and welded together, the respective hermetically sealed portions of the two inner tubes have a lateral length more than half of that of the hermetically sealed portion of the outer tube, and a part of the one inner tube and a part of the other inner tube overlap each other.

The second object of the present invention is achieved by providing a tube container comprised of an outer tube formed with an extruding mouth at one end and two inner tubes each formed with an extruding mouth at one end thereof, the inner tubes being inserted into the outer tube, the extruding mouths of the two inner tubes being secured to the extruding mouth of the outer tube, and the other ends of the two inner tubes and the other end of the outer tube being pressed and welded together to form a hermetically sealed portion, the outer tube is formed with a vent hole connecting the inside of the outer tube with the outside thereof, and a check valve is attached to the vent hole so that the check valve allows air to enter the outer tube, but prevents air from exiting the outer tube.

In the above-mentioned tube container, the outer tube has a transverse cross section taking the form of an ellipse or a track, and a part of one inner tube and a part of the other inner tube overlap each other in the hermetically sealed portion. Accordingly, the volume of the inner tubes is increased relative to the size of the tube container. On the other hand, the size of the outer tube can be reduced, when the volume of the inner tubes is set to a given value.

In the tube container with a vent hole formed in the outer tube, reduced volume within the tube container by contents being squeezed out of the inner tubes is compensated with the volume of air entering the outer tube through a vent hole from the outside when the outer tube is restored to the original state. Therefore, the restoration of the inner tubes to the original state does not occur, and air is prevented from entering the inner tubes from the outside of the tube container, therefore the contents always exist about the extruding mouth of the inner tubes. Accordingly, the tube container of the present invention has good usability. At the same time, in the tube container of the present invention, one content in one inner tube is prevented from entering the other inner tube together with air. Further, since a check valve prevents air from entering the outer tube when the outer tube is pressed so that the outer tube can be kept in shape.

DETAILED DESCRIPTION OF THE PREFERRED EMBODIMENTS

Referring to FIGS. 1 to 9, the embodiments of the tube container of the present invention are explained. First, referring to FIGS. 1 to 4, the construction of the whole and parts of the tube container are explained. Then, referring to FIGS. 5 to 7, a method of making the tube container is explained, and referring to FIGS. 8 and 9, the function of the tube container is explained.

Figure 1:
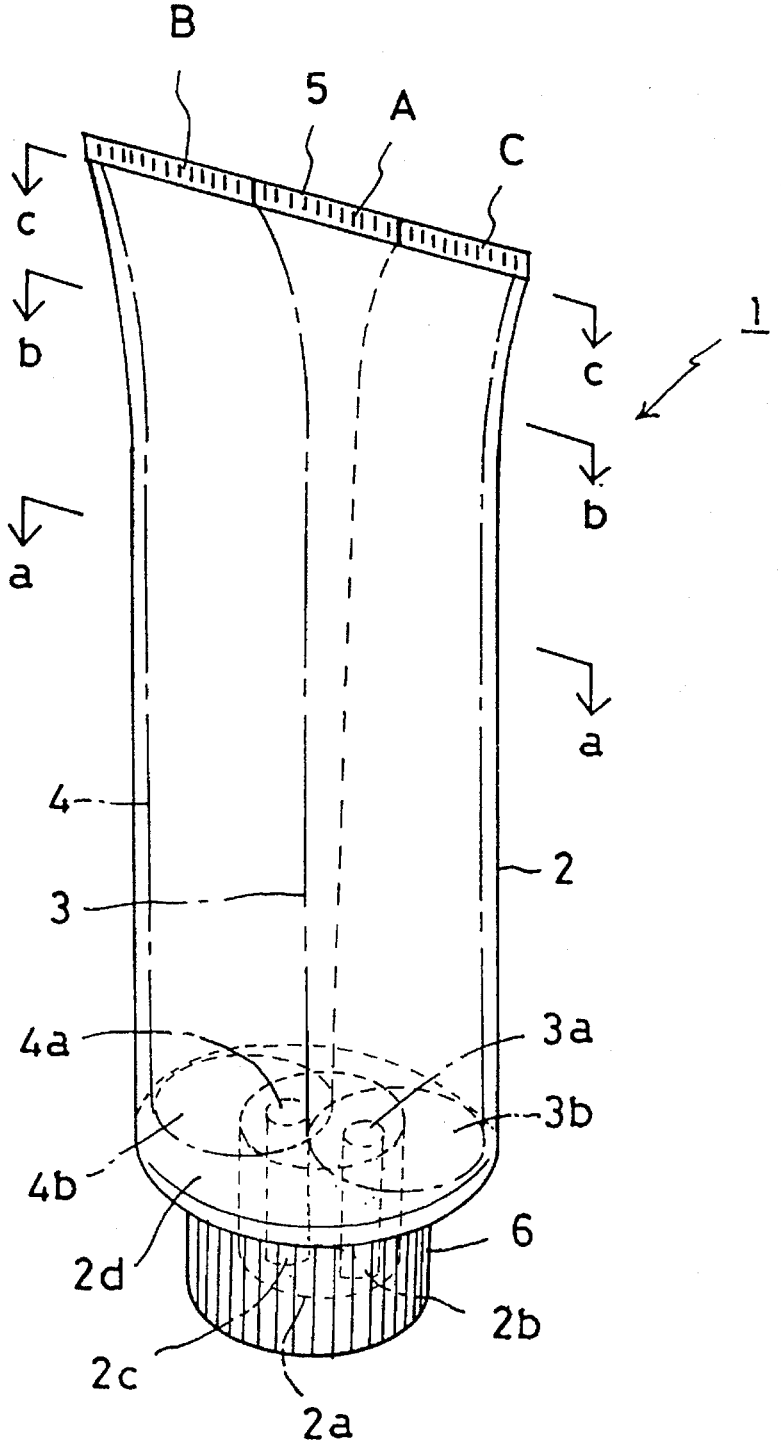
FIG. 1 is a sectional view of a tube container of the present invention.
Figure 2A:
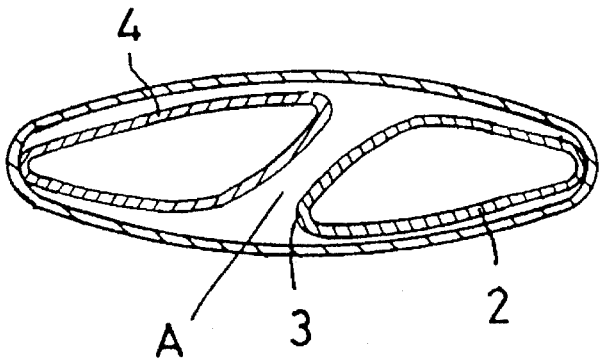
FIGS. 2(*a*), 2(*b*), and 2(*c*) are sectional views taken on line a—a, line b—b, and line c—c, respectively.
Figure 2B:
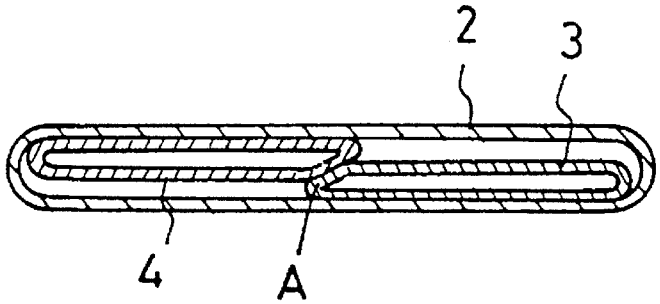
Figure 2C:
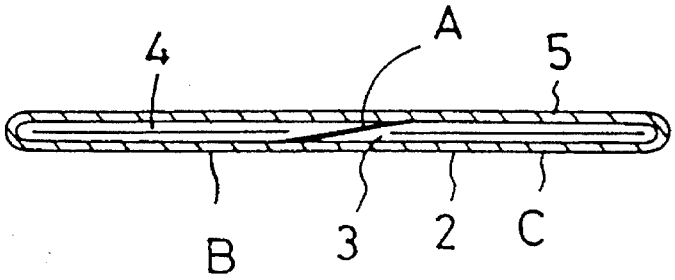
Figure 3:
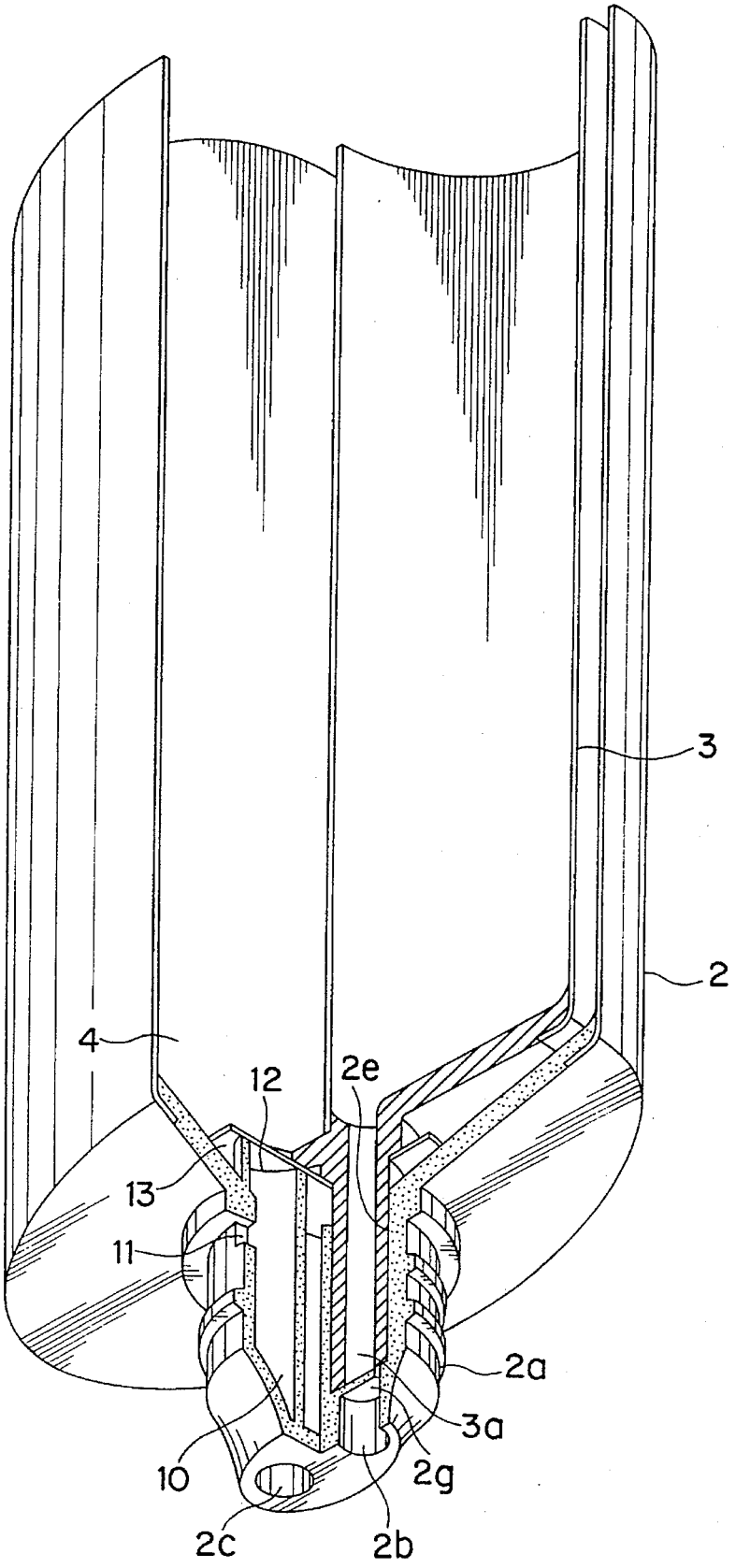
FIG. 3 is an enlarged partially sectional view of an extruding mouth of the tube container.
Figure 4:
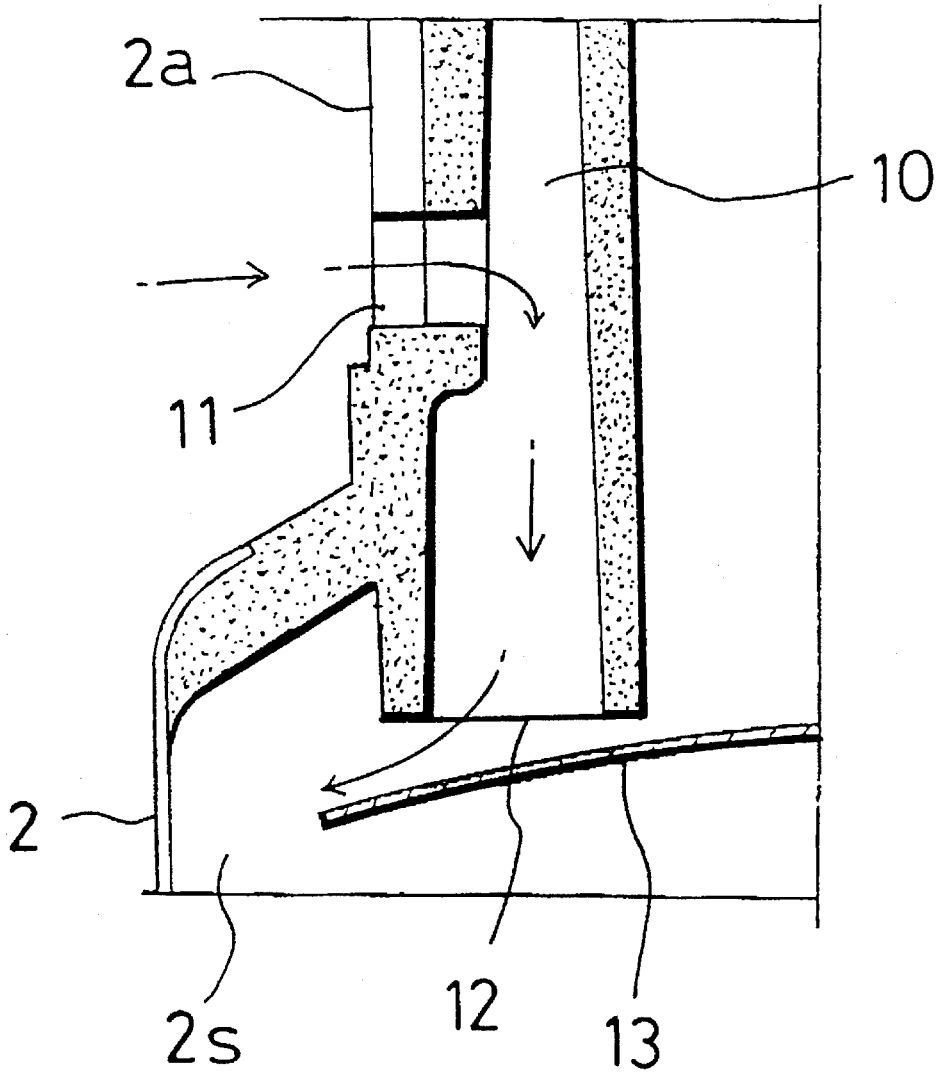
FIG. 4 is an enlarged partially sectional view of an extruding mouth of an outer tube.

The construction of the tube container of the present invention is explained. FIG. 1 is a sectional view of a tube container of the present invention, FIGS. 2(*a*), 2(*b*), and 2(*c*) are sectional views taken on line a—a, line b—b, and line c—c, respectively. FIG. 3 is an enlarged partially sectional view of an extruding mouth of the tube container, and FIG. 4 is an enlarged partially sectional view of an extruding mouth of an outer tube.

As shown in FIG. 1, a tube container 1, according to the present invention, comprises an outer tube 2 and two inner tubes 3, 4 inserted in the outer tube 2. The outer tube 2 and the two inner tubes 3, 4 are made of semitransparent and flexible polyethylene so that contents, for example cosmetics such as washing gel, contained in the inner tube containers 3, 4 can be observed from the outside of outer tube 2. The outer tube 2 has a transverse cross section taking the form of an ellipse or a closed running track shape, namely a shape combining two semicircles with two straight lines.

One end of each of the inner tubes 3, 4 (lower ends of the inner tubes 3, 4 in FIG. 1) have circular shoulders 3*b*, 4*b*, which are formed with extruding nozzles 3*a*, 4*a*, respectively. These extruding nozzles 3*a*, 4*a* of the inner tubes 3, 4 are held inside of an extrusion nozzle 2*a* of the outer tube 2 to form integral parts of the inside of the extruding nozzle 2*a*. The outside of extruding nozzle 2*a* of the outer tube 2 is threaded in such a manner that a cap 6 can be put on the outside of the extruding nozzle 2*a*.

Referring to FIG. 3, an engagement of the inner tubes 3, 4 with the outer tube 2 is explained. Extrusion nozzle 2*a* of the outer tube 2 has extruding holes 2*c*, 2*b* which open to the outside of the outer tube 2. The extruding holes 2*c*, 2*b* have larger diameter insertion holes 2*e*, 2*e* (only one insertion hole is shown in FIG. 3), into which extruding nozzles 3*a*, 4*a* of the inner tubes 3, 4 are inserted.

Extrusion nozzles 3*a*, 4*a* and insertion holes 2*e*, 2*e* have an engaging convex portion (not shown in the figures) and an engaging concave portion (not shown in the figures), respectively so that extruding nozzles 3*a*, 4*a* can be held against the insertion holes 2*e*, 2*e* by the engagement of the engaging convex portion with the engaging concave portion. The extruding nozzle 2*a* has valves 2*g*, which are integrally provided by the extruding holes 2*c*, 2*b* (which one valve provided on the side of extruding hole 2*c* is shown in FIG. 3) so that contents which have once passed through the extruding nozzles 3*a*, 4*a* to the outside of the inner tubes 3, 4 cannot flow back to the inside of the inner tubes 3, 4.

As shown in FIGS. 3 and 4, the extruding nozzle 2*a* has a vent line 10 which connects the inside of the outer tube 2 with the outside thereof, apart from extruding holes 2*c*, 2*b*. One side of the vent line 10 is connected with a vent port 11 which is formed in the side of extruding nozzle 2*a*, while the other side of the vent line 10 is connected with the vent hole 12 which opens into the inside of the outer tube 2.

Further, the outer tube 2 is provided with a flexible check valve 13 on the inside of shoulder 2*d* so that the vent hole 12 is closed by the check valve 13 at ordinary times, thereby the vent line 10 is closed. The check valve 13 is a thin plastic circular plate, which is provided on the inside of a shoulder 2*d* in such a manner that the check valve 13 encloses the extruding nozzles 3*a*, 4*a* of the inner tubes 3, 4. When air flows from the outside of the outer tube 2 to the inside thereof, namely, when air flows from the vent port 11 toward the vent hole 12 through the vent line 10, the check valve 13 is opened to open the vent line 10 to the outside of outer tubes 3, 4 so that the check valve 13 allows air to exit from the inside of the outer tube 2 to the inside thereof. On the other hand, when air moves toward the vent part 11 via the vent hole 12, the check valve 13 prevents air from exiting the outer tube 2 by closing the vent line 10.

The opposite ends of shoulders 2*d*, 3*b*, 4*b* (the upper end of outer tube 2 and the inner tubes 3, 4) of the outer tube 2 and the inner tubes 3, 4 are heat-welded to form a hermetically sealed portion 5. At the hermetically sealed portion 5, the inner tube 3 and the inner tube 4 are positioned on left and right sides of the tube container 1. Each of the inner tubes 3, 4 has a circumference over one half (½) of the circumference of the outer tube 2.

Accordingly, ends of the inner tubes 3, 4 partially overlap at the center of hermetically sealed portion 5 to form superimposed portion A, in which a hermetically sealed portion of six layers is composed of four layers of inner tubes 3, 4 and two layers of outer tube 2. In superimposed portions B, C on both sides of the portion A, a hermetically sealed portion of four layers is composed of two layers of each of the inner tubes 3, 4 and two layers of the outer tube 2. Referring to FIG. 2, the construction of the hermetically sealed portion 5 is explained hereinafter.

FIGS. 2(*a*), 2(*b*), and 2(*c*) are cross sections taken on line a—a, line b—b, and line c—c in FIG. 1, respectively. As shown in FIG. 1, a shoulder 3*b* of the inner tube 3 and a shoulder 4*b* of the inner tube 4 come in contact with each other. As shown in FIGS. 2(*a*), 2(*b*), and 2(*c*), the inner tubes 3, 4 (superimposed portion A) partially lie upon the other from the shoulders 3*b*, 4*b* toward the hermetically sealed portion 5, wherein parts of the inner tubes 3, 4 which are superimposed are heat-welded.

Figure 5:
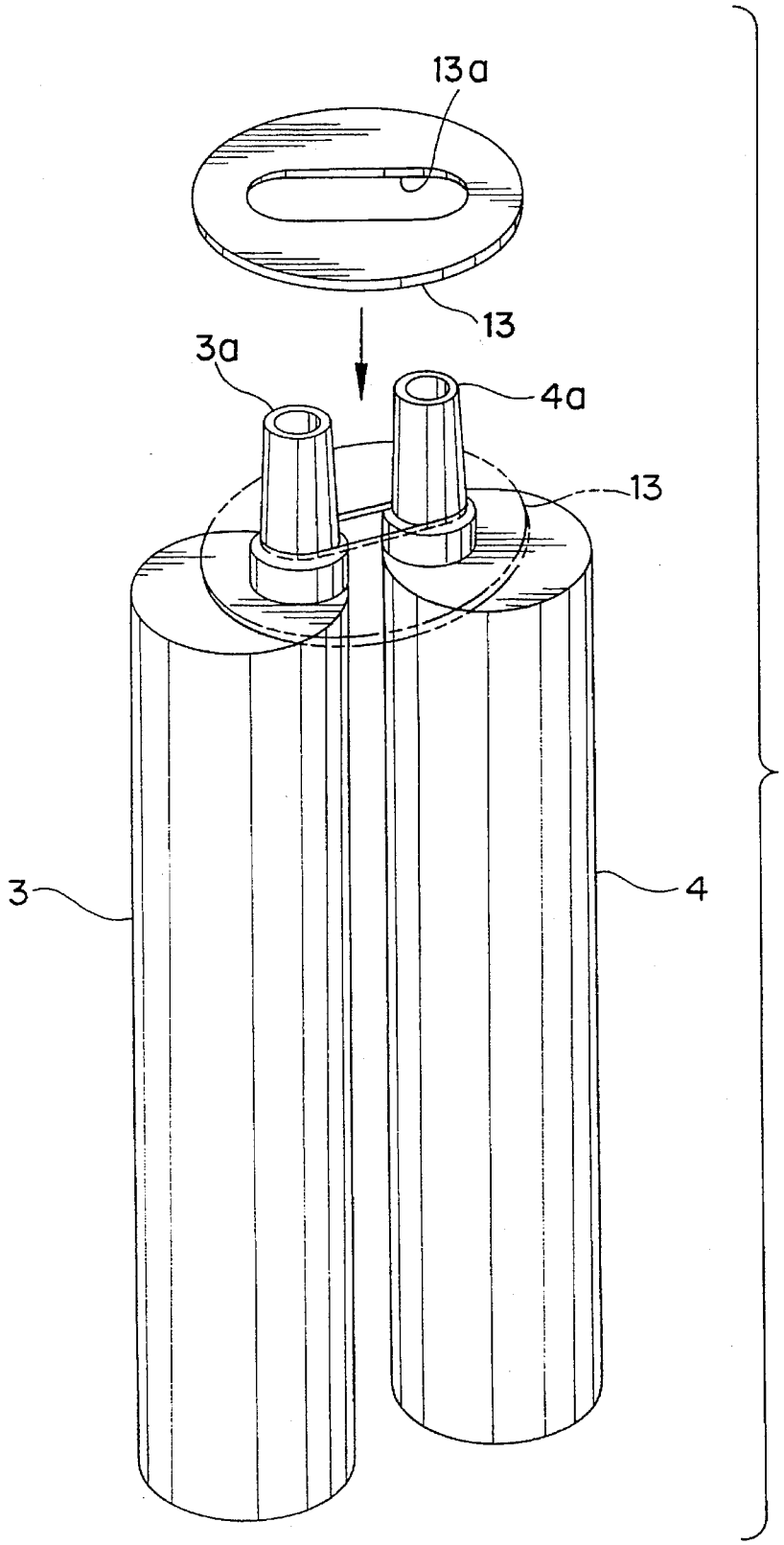
FIG. 5 is a perspective view of inner tubes for showing a method of attaching a check valve to the inner tubes.
Figure 6:
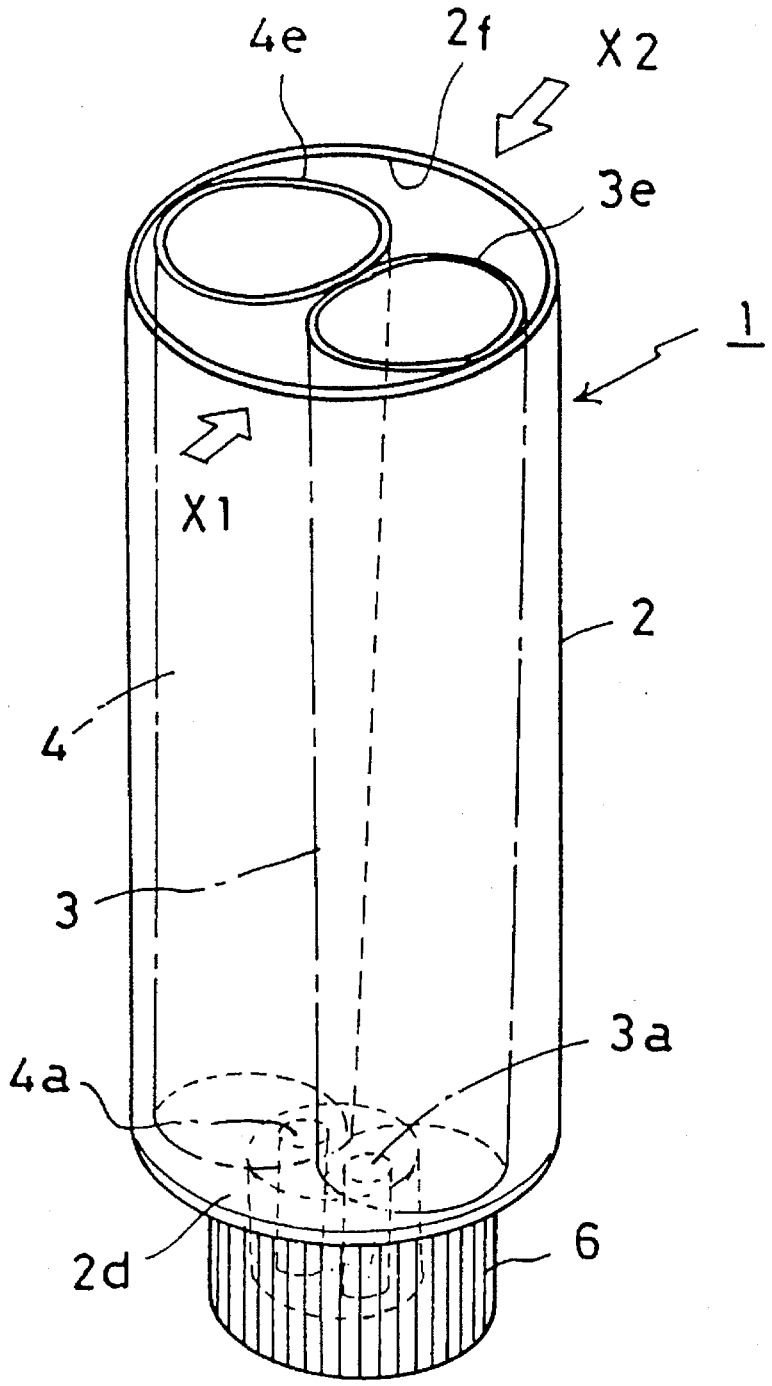
FIG. 6 is a perspective view of the tube container before welding of a bottom end of the tube container.
Figure 7:
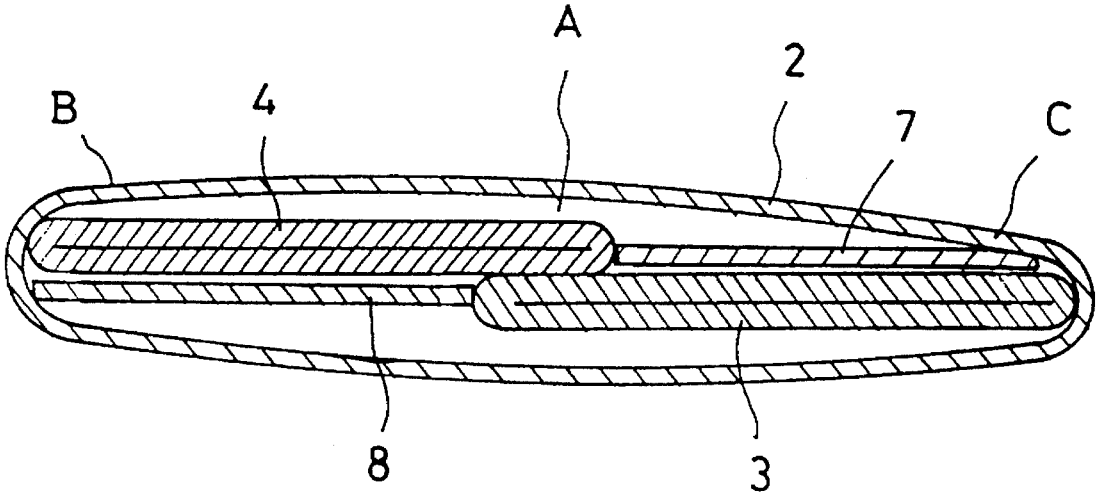
FIG. 7 is a sectional view of the hermetically sealed portion of the tube container in which spacers are used.

Referring to FIGS. 5 to 7, a method of making a tube container according to the present invention is explained. FIG. 5 is a perspective view of inner tubes 3, 4 for showing a method of attaching a check valve to the tube container according to the present invention. FIG. 6 is a perspective view of the tube container according to the present invention in which heat-welding is not made for the upper end of the tube container. As shown in FIG. 5, the ends of the inner tubes 3, 4, at the opposite sides of the extruding nozzles 3*a*, 4*a*, are opened, are arranged, and the extruding nozzles 3, 4 are inserted into the retaining hole 13*a* of the check valve 13 so that both extruding nozzles 3*a*, 4*a* are connected with each other through the check valve 13.

Then, as shown in FIG. 6, the above-mentioned inner tubes 3, 4 are inserted into the outer tube 2, while extruding nozzles 3*a*, 4*a* of the inner tubes 3, 4 are inserted into the inside of extruding nozzle 2*a* of the outer tube 2 so that extruding nozzles 3*a*, 4*a* of the inner tubes 3, 4 are secured to extruding nozzle 2*a* of the outer tube 2. These inner tubes 3, 4 are inserted into the outer tube 2 so that outer surfaces of the inner tubes 3, 4 make contact with an inner surface of the outer tube 2 to fix locations of openings 3*e*, 4*e* in the outer tube 2. Then, charging nozzles (not shown in the figures) are inserted into openings 3*e*, 4*e* of the inner tubes 3, 4, and contents are charged into inner tubes 3, 4.

Then, an opening 2*f* of the outer tube 2 is pressed to flatten from both sides X1, X2 in a minor axis direction and heat-welded with ends of the inner tubes 3, 4 so that the hermetically sealed portion shown in FIG. 1 is formed. Since the openings 3*e*, 4*e* of the inner tubes 3, 4 have a circumference over one half (½) of the circumference of the opening 2*f* of the outer tube 2, when the openings 3*e*, 4*e* are flattened by being pressed in the minor axial direction of the elliptical shoulder 2*d*, the two inner tubes 3, 4 partially overlap to form the superimposed portion A mentioned above. Characters showing trademark and contents may be preprinted on the outer tube 2, or after the opening 2*f* of outer tube 2 has been sealed, a label may be put on the outer tube 2.

As shown in FIG. 7, spacers 7, 8 may be used at the hermetically sealed portion 5 so that locations of the inner tubes 3, 4 can be made securely to lessen a difference formed between superimposed portion A and non-superimposed portions B, C. The spacers 7, 8 can be pieces made of the same plastic resin as of the outer tube 2 and the inner tubes 3, 4. The spacers 7, 8 are inserted between the outer tube 2 and the inner tubes 3, 4 at the hermetically sealed portion 5, and heat-welded with the outer tubes 2 and the inner tubes 3, 4 together.

In the above-mentioned tube container, since the inner tubes 3, 4 overlap at the hermetically sealed portion 5, the inner tubes 3, 4 with large diameters can be used and it is possible to make a tube container having a large space for charging the contents. Further, if the diameter of the inner tubes 3, 4 is the same as the diameter of the conventional inner tubes, the diameter of outer tube 2 can be relatively reduced compared to a conventional tube container. Particularly, because the shoulder 2*d* of the outer tube 2 has an elliptical shape, waste of space between the inner tubes 3, 4 and the outer tube 2 can be lessened to keep the size of the tube container 1 compact.

Figure 8:
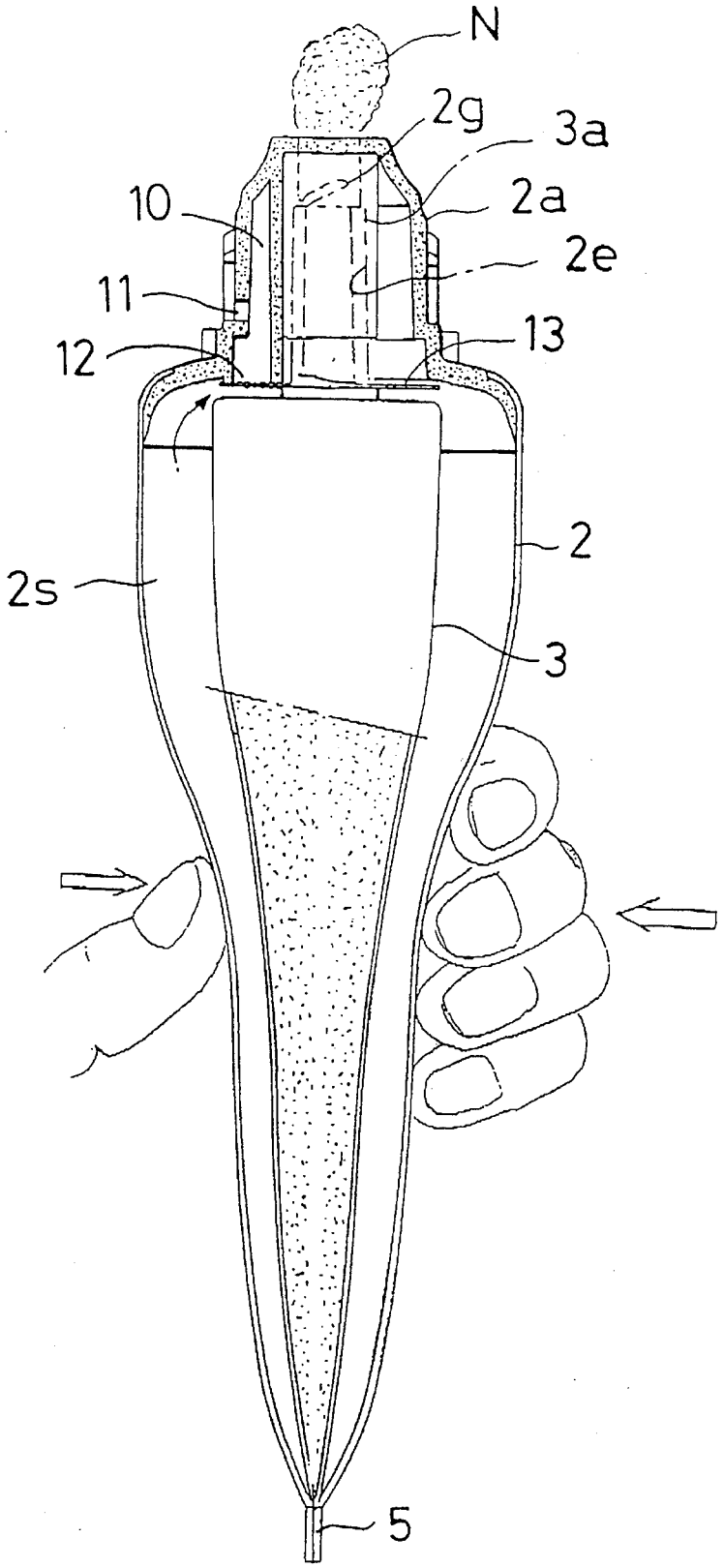
FIG. 8 is a sectional side elevation for showing the state where the tube container is pressed.
Figure 9:
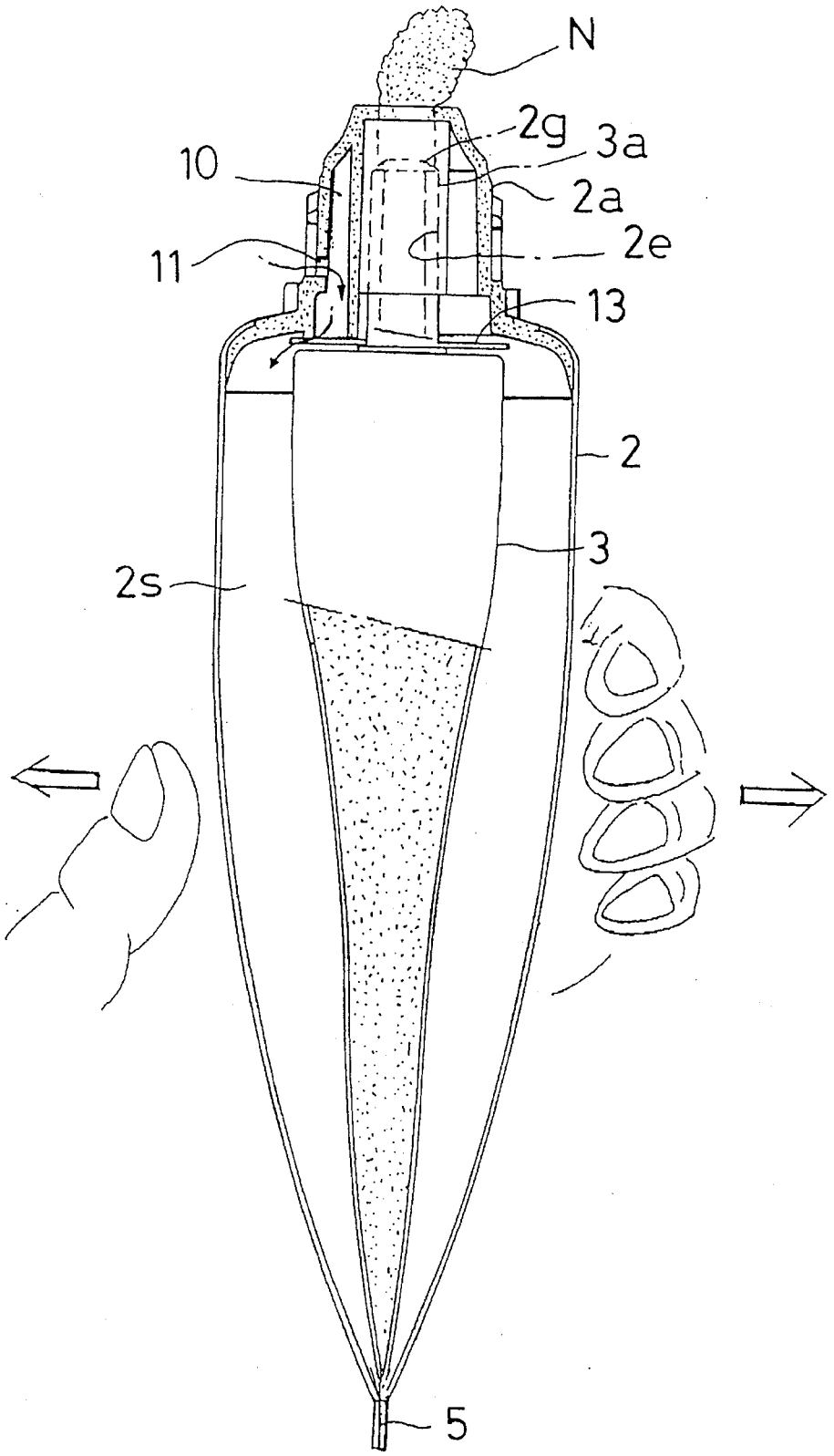
FIG. 9 is a sectional side elevation for showing the state where the outer tube is restored to the original state.

Then, referring to FIGS. 8 and 9, the function of the above-mentioned tube container in use is explained. FIG. 8 is a sectional view of a tube container according to the present invention for showing the state where contents are squeezed out by pressing the tube container. FIG. 9 is a sectional view of the tube container for showing the state where after the pressure against the tube container is removed, the tube container is restored to the original shape.

As shown in FIG. 8, as the inner tube 3 is crushed by pressing the outer tube 2 of the tube container 1, the content N in the inner tube 3 is squeezed out through valve 2*g* on the upper end of the extruding nozzle 3*a* and the extruding nozzle 2*a* of the outer tube 2 (in FIGS. 8 and 9, the tube container observed from the side of the inner tube 3 is shown. The inner tube 4 has the same structure as the inner tube 3.). At this time, although pressure is applied against space 2*s* in the outer tube 2, as the vent hole 12 of the vent line 10 is closed by the check valve 13, air cannot exit the outer tube 2. The same is said of the inner tube 4.

Then, as shown in FIG. 9, when the pressure against the tube container 1 is removed, the outer tube 2 is restored to the original shape by flexibility of the material of the outer tube 2. At this time, the check valve 13 makes the vent line 10 open for the space 2*s* so that air outside the outer tube 2 flows in through the vent port 11 and the vent line 10 into the space 2*s*. Namely, the volume of the outer tube 2 is reduced by the volume of the contents N squeezed out from the inner tube 3, however, the reduced volume is replenished with air entering through the vent line 10. On the other hand, when air flows from the extruding nozzle 3 into the inner tube 3, the valve 2*g* at the upper end of the extruding nozzle 3*a* is closed to prevent air from entering into the inner tube 3.

The tube container of the present embodiment has good usability that after a certain quantity of the content has been squeezed out, air is prevented from entering into the inner tubes 3, 4 of the tube container by the valves 2*g*, 2*g*, so the content of the container 1 can be readily squeezed out when used thereafter. Particularly, the tube container of the present embodiment can be preferably employed in a case in which content has a substance which should be prevented from contact with air. Further, first content charged in the inner tube 3 or the second content charged in the inner tube 4 is prevented from being contaminated with the second content or the first content in each inner tube 3, 4 as well as air.

With the tube container according to the present invention, the volume of the inner tube or the inner tube can be made relatively large for a size of the outer tube, since a portion of the inner tube and a portion of the other inner tube overlap in the hermetically sealed portion. Accordingly, the tube container can efficiently accommodate two different kinds of contents. Further, the size of the outer tube can be reduced while a given volume of the inner tube is secured. According to the present embodiment, a compact container can be made in comparison to a conventional container.

Further, in the tube container of the present invention, which has the vent hole in the outer tube, a volume of the contents squeezed out of the inner tubes is replenished with air entering the outer tube through the vent hole by which air can be prevented from entering inner tubes. Accordingly, as the contents exist always about mouths of the inner tubes, the usability of the tube container is excellent. Further, the content squeezed out of one inner tube can be prevented from being drawn into the other inner tube. Furthermore, the check valve prevents air from exiting the outer tube by which the external form of the outer tube can be kept constant so that a tube container which presents a fine spectacle can be provided.

The individual components shown in outline or designated blocks in the drawings are well known in the container arts, and their specific construction and operation are not critical to the operation or best mode for carrying out the invention.

While the present invention has been described with respect to what is presently considered to be the preferred embodiment, it is to be understood that the invention is not limited to the disclosed embodiment. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A tube container having an outer tube formed with an extruding mouth at one end and two inner tubes each formed with an extruding mouth at one end thereof, said inner tubes being inserted into said outer tube so that said extruding mouths of said two inner tubes are secured into said extruding mouth of said outer tube, and the other ends of said two inner tubes and the other end of said outer tube are pressed and welded together to form a hermetically sealed portion, comprising;

said outer tube having a transverse cross section of an ellipse or a closed running track shape;

said inner tubes arranged in said outer tube in a direction of a major axis of the transverse cross section of said outer tube;

said hermetically sealed portion of said two inner tubes and said outer tube being pressed in a direction of a minor axis of said transverse cross section and welded together; and said respective inner tubes having a length more than half of said hermetically sealed portion of said outer tube when pressed in said direction of the minor axis so that said respective inner tubes partially overlap each other.

2. A tube container according to claim 1, further comprising:

a spacer disposed next to a gap formed by said two inner tubes said spacer being welded with said outer tube and said two inner tubes to make said hermetically sealed portion flat.

3. A tube container according to claim 2, wherein said spacer includes, a first spacer disposed between an inner wall of said outer tube and an outer wall of one of said two inner tubes along a major axis of said transverse cross section without overlapping the partially overlapped portion; and a second spacer disposed between an inner wall of said outer tube and an outer wall of the other of said two inner tubes along a major axis of said transverse cross section without overlapping the partially overlapped portion, wherein said first and second spacers being welded together with said outer tube and said inner tubes such that said hermetically sealed portion is substantially flat.

4. A tube container according to claim 1, further comprising:

a vent hole provided in said outer tube to connect the inside of said outer tube with the outside thereof, and a check valve disposed in said vent hole so that said check valve allows air to enter said outer tube, and prevents air from exiting said outer tube.

5. A tube container comprising:

an outer tube formed with an extruding mouth at one end;

two inner tubes each formed with an extruding mouth at one end thereof, said inner tubes being inserted into said outer tube so that said extruding mouths of said two inner tubes are secured into said extruding mouth of said outer tube, and the other ends of said inner tubes and said outer tube are pressed and welded together to form a hermetically sealed portion;

a vent hole, provided on said outer tube, connecting the inside of said outer tube with the outside thereof; and a check valve, disposed in said vent hole so that said check valve allows air to enter said outer tube and prevents air from exiting said outer tube, wherein said two inner tubes partially overlap each other.

6. A tube container according to claim 5, wherein said check valve is a ring-shaped thin plate.

* * * * *